United States Patent [19]

Haynes

[11] Patent Number: 5,000,065

[45] Date of Patent: Mar. 19, 1991

[54] JAW ASSEMBLY FOR POWER TONGS AND LIKE APPARATUS

[75] Inventor: Charles W. Haynes, Marshall, Tex.

[73] Assignee: Martin-Decker, Inc., Cedar Park, Tex.

[21] Appl. No.: 480,323

[22] Filed: Feb. 8, 1990

Related U.S. Application Data

[63] Continuation of Ser. No. 93,921, Sep. 8, 1987, abandoned.

[51] Int. Cl.[5] ..... B25B 17/00

[52] U.S. Cl. ..... 81/57.2; 81/57.15; 81/57.33; 81/467; 81/472; 279/64

[58] Field of Search ..... 81/57.15, 57.16, 57.18, 81/57.33, 57.34, 57.2, 467, 98, 472, 473, 476; 279/64, 33; 773/163, 164

[56] References Cited

U.S. PATENT DOCUMENTS 1,072,142 9/1913 Miller ..... 279/33

2,693,365 11/1954 Von Zelewsky ..... 82/165

3,413,876 12/1968 Shinn ..... 81/53

3,610,640 10/1971 Bollin et al. ..... 81/57.18

*Primary Examiner*—Frederick R. Schmidt

*Assistant Examiner*—Lawrence Cruz

*Attorney, Agent, or Firm*—William P. Green

[57] ABSTRACT

A jaw assembly for apparatus for gripping pipes, the apparatus being of the type having automatic means for exerting increased gripping force upon application thereto, is provided with a member having a concave surface which cooperates with a gripped pipe to override the automatic means for exerting increased gripping force. Having such a member, the jaw assembly of the present invention can exert a predetermined maximum gripping force on a gripped pipe notwithstanding amount of torque applied to the apparatus. Considering angular relationships involving jaw cam angle, the present invention can be manifested in an increasing cam angle jaw for power tongs.

5 Claims, 4 Drawing Sheets

JAW ASSEMBLY FOR POWER TONGS AND LIKE APPARATUS

This is a continuation of co-pending application Ser. No. 07/093,921 filed on 9/8/87 now abandoned.

BACKGROUND OF THE INVENTION

1. Field of the Invention

This invention relates to apparatus which grip and rotate pipe and the like and, more particularly, to the components of such apparatus which make contact with the pipe or the like being gripped and rotated.

2. Description of the Prior Art

There are many devices and mechanisms now on the market which are utilized to grip and rotate pipe. Some operate manually, while others are power assisted. In oil and gas drilling operations, it is necessary to grip pipes, rods and other axially elongated bodies with extremely high compressive forces while applying a high degree to torque in order to connect together or disconnect threaded end sections of such bodies. In order to develop the desired forces, power tongs have been designed for gripping and rotating pipe used in oil and gas drilling operations. Examples of power tongs may be seen in the following U.S. Pat. Nos.: U.S. Pat. No. 4,095,493, 4,250,773, 4,437,363, 4,404,876, 4,082,017, 4,290,304 and 4,648,272.

As can be seen in the above listed patents, power tongs may be open-headed, having a housing with a central opening and an outward-open passageway or throat which permit the tong to be positioned around a pipe. On the other hand, power tongs may be close-headed, having no outward-open passageway or throat, being designed to be lowered over a length of pipe into an operating of position.

When a tong is operated, pipe griping means (often referred to as jaws) are caused to revolve around the aforesaid central opening, these jaws causing the pipe or axially elongated object being gripped thereby to axially rotate. Typically, tongs have three to five jaws. These jaws are rotatably located inside a rotary member (referred to as a rotor) which is gear or chain driven. The rotor is powered through a gear train from a hydraulic or air motor. The jaws are generally in contact with a drag band arrangement, whereas when the rotor and jaws are rotated, the drag band will create a drag on the jaws causing them to pivot around their pivot points making initial contact with the pipe O.D. As can be seen with reference to certain of the U.S. patents noted above, in some tongs the actual contact with the pipe is accomplished through the use of replaceable inserts mounted on a jaw member. Whether contact with the pipe is made by an integral jaw or by an insert mounted on a jaw, continued rotation of a "gripping" tong causes the rotation of a gripped pipe.

Problems have developed with the above-mentioned jaw and jaw/insert configurations. Partly because of a belief that size of the contacting elements or contacting portions of elements must be small in order to penetrate the pipe and resist the amount of torque which may be applied to rotate the pipe, prior art inserts and contacting portions of jaws have been formed so as to have small wearing surfaces. These small wearing surfaces cause tremendous pressures (per unit of area) being applied to drill pipe. These pressures can result in deformation of pipe, which in turn results in down time and pipe replacement costs. This is especially true in deep water drilling operations, where lightweight pipe must be utilized. Prior art tongs lack means by which radial forces exerted on pipes are limited notwithstanding amount of torque applied to a tong.

The present invention overcomes the problems and shortcomings of the prior art by providing an assembly for gripping a pipe for rotation of said pipe upon application of torque to the assembly, said assembly being of the type having automatically operating means for exerting increasing gripping force as amount of torque applied to the assembly increases, said assembly further having novel means for overriding and limiting said automatic means for exerting increased gripping force upon application of torque thereto.

Accordingly, it is an object of the present invention to provide an improved power tong of the type used to make up and break out tool joints in oil field drilling operations.

It is another object of the present invention to provide a novel power tong that has means for limiting radial force regardless of amount of applied torque.

It is yet another object of the present invention to provide a power tong that can be used to rotate lightweight pipe without deforming such pipe.

Still yet another object of the present invention is to provide replaceable inserts which can be used with power tong jaws accepting such inserts, which inserts provide the advantages offered by the present invention.

The above and other objects, advantages, and features of the present invention will become more apparent from the following detailed description, taken in conjunction with the accompanying drawings wherein:

BRIEF DESCRIPTION OF THE EMBODIMENTS

Figure 1:
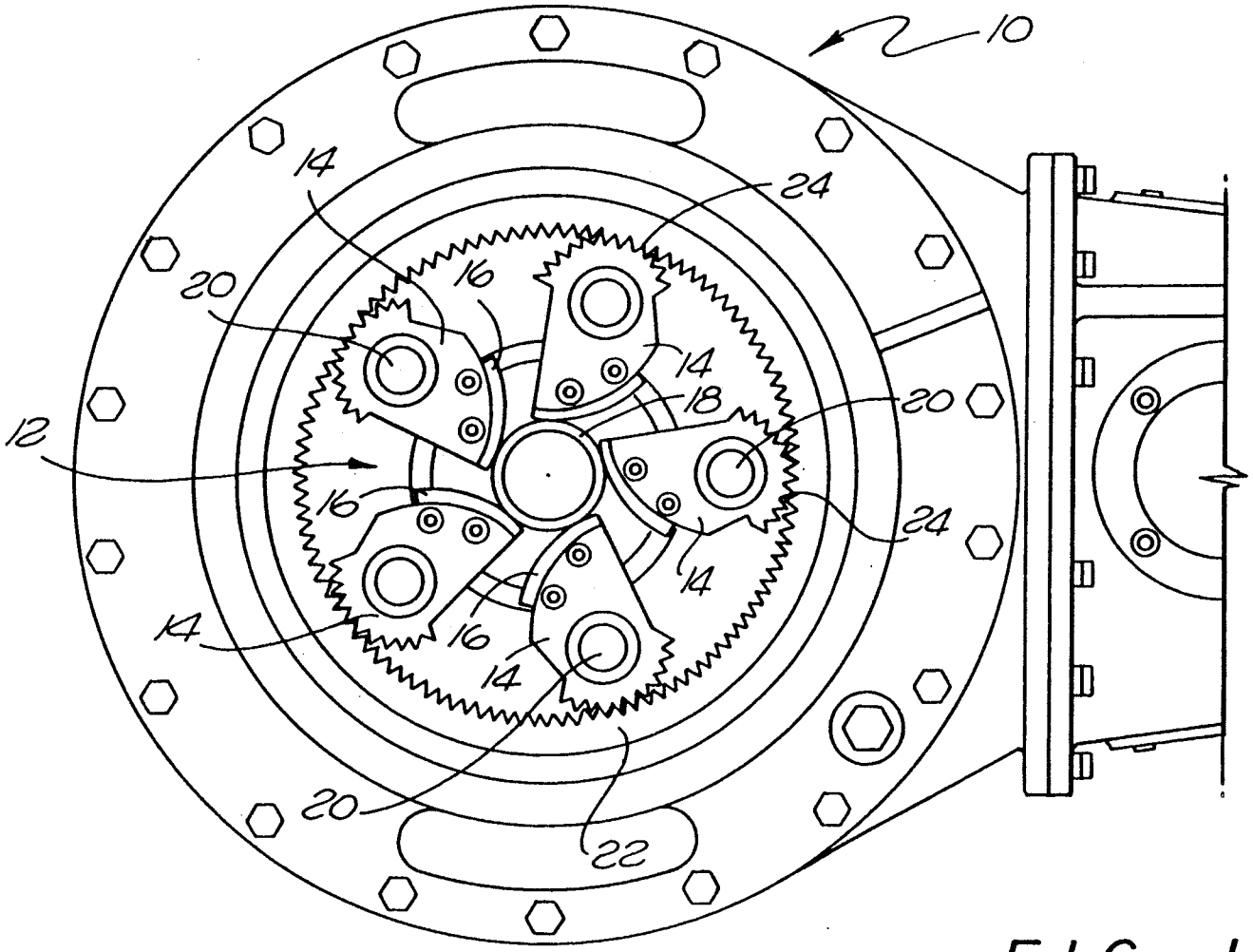
FIG. 1 (PRIOR ART)
FIG. 1 shows a relevant portion of a power tong having a prior art jaw assembly.

With reference now to the drawings and, in particular, to FIG. 1, shown therein is a relevant portion of a power tong 10 having a prior art jaw assembly 12. Components and operation of power tongs are well known to those skilled in the art and, accordingly, will be discussed now only to the extent of pointing out those elements mentioned in the prior art section above. Prior art jaw assembly 12 has five jaws 14, each having a replaceable insert 16 mounted thereon by known, conventional means. The replaceable inserts 16 are shown in FIG. 1 to be in contact with a pipe 18 that can be gripped and rotated by operation of power tong 10. Each jaw is pivotedly mounted at a pivot 20. The jaws are all located inside rotor 22 which is driven by conventional means (such as chain 23 shown in FIG. 3), which drive is powered by a conventional motor (not shown). Cooperating gear teeth 24 on the jaws 14 and rotor 22 cause the jaws 14 to pivot in response to rotor 22 movement, which jaw pivoting leads to pipe 14 gripping and rotating which are the desired results of use of a power tong.

Figure 2:
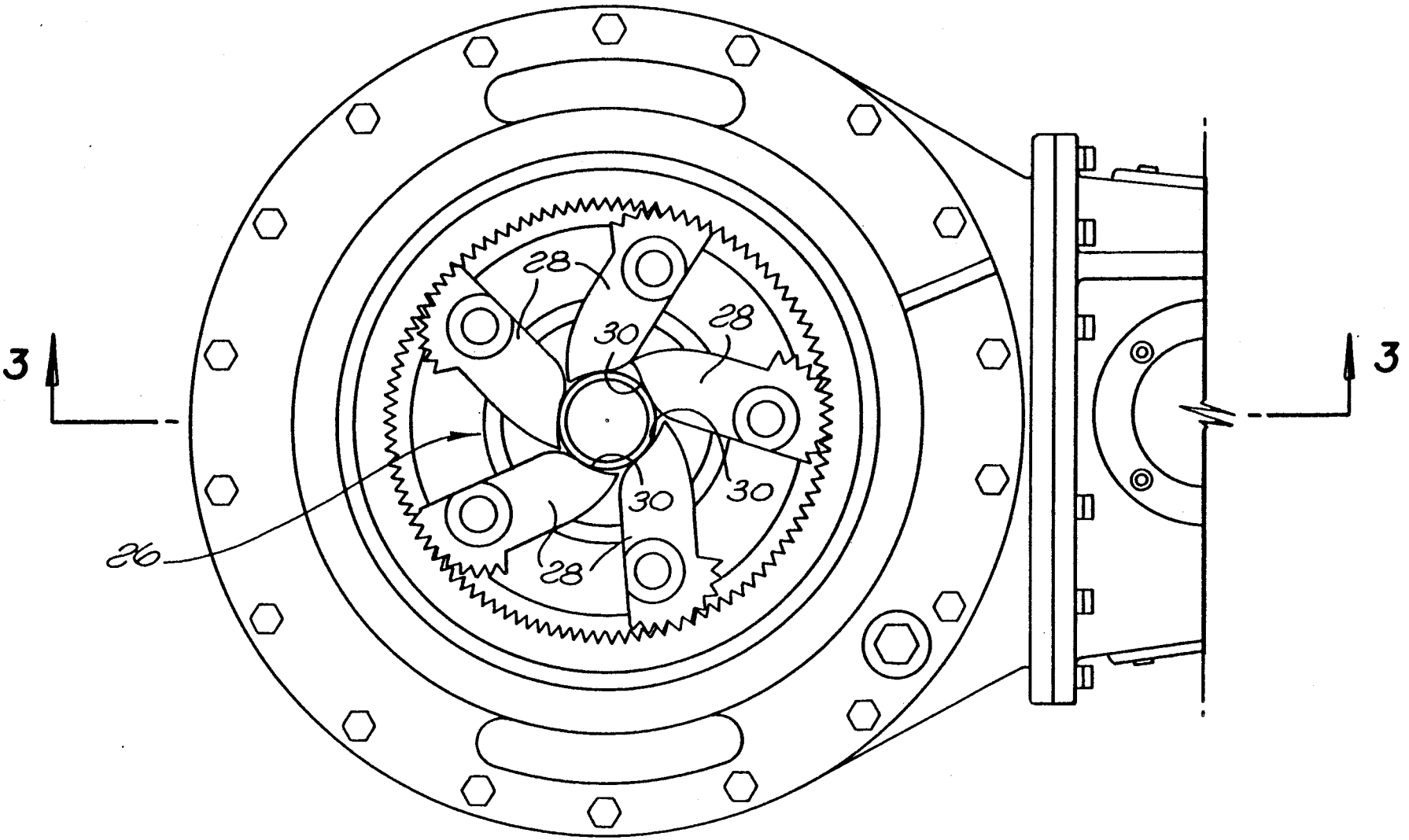
FIG. 2 shows a portion as in FIG. 1 but the tong partially shown therein has a jaw assembly according to the present invention.

Referring now to FIG. 2, shown therein is a relevant portion of a power tong 10 having a jaw assembly 26 according to the present invention. For convenience, as with the designation 10 for power tong, like or similar elements, even as between prior art views and views .of the present invention, will be marked with the like reference numbers throughout both the specification and drawing. Jaw assembly 16 differs from prior art jaw assembly 12 in shape of the gripping portions thereof. Specifically, whereas prior art gripping portions inserts 16 in FIG. 1 have a completely convex shape (or more precisely, a constant "cam angle," a term that will be described in further detail below) the gripping portions of jaws 28 in FIG. 2 have also have a concave portion 30 (or portion manifesting an increasing cam angle), so that the complete gripping surface is in the form of an ogee.

Figure 4:
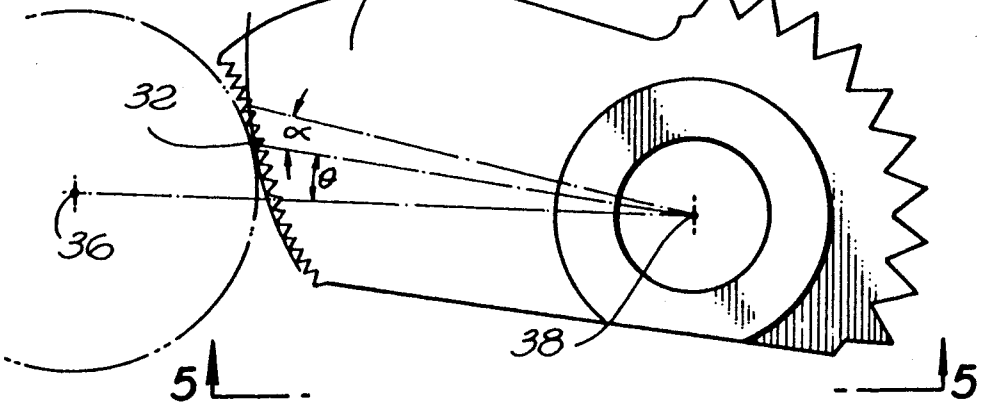
FIG. 4 is a plan view of an integral jaw according to the present invention in contact with the outer surface of a pipe, this view having important angular relationships noted thereon.

With reference to FIG. 4, the increasing cam angle aspect of the present invention is shown therein in greater detail. It may be noted that the contact point between the pipe O.D. and the gripping portion of the illustrative jaw, point 32, form an angle $\theta$ with relation to the centerline of the pipe 36 and the pivot point 38 of the jaw 28. Angle $\theta$ is the herebefore mentioned cam angle. As those skilled in the art will appreciate, as a tangential force is applied in an opposite direction of the cam angle $\theta$, a radial force is transmitted to the pipe O.D. This radial force is generally large compared to the tangential force. For example, if the cam angle were 5° and a 1200# tangential force were applied, radial - force transmitted to pipe 5 would be 13,700#. Such large radial forces can cause pipe deformation before pipe rotation, an undesired consequence for reasons mentioned in the prior art section above.

With further reference to FIG. 4, it can be seen that the jaw design shown therein has a $\alpha°$ rotation for gripping pipe penetration, at which point those skilled in the art will appreciate that the reverse radius will become tangent to the pipe. At this point the cam angle will start increasing very rapidly until the reverse radius is contacting the pipe O.D. The radial force at this position will be a maximum regardless of how much additional tangential force is applied. Accordingly, the increasing cam angle feature of the present invention limits radial force regardless of applied torque and, thus, is better than prior art devices which increase radial force proportionately to the tangential force as torque is applied. Through use of the present invention, the possibility of crushing or damaging drill pipe can be minimized, if not eliminated.

Figure 6:
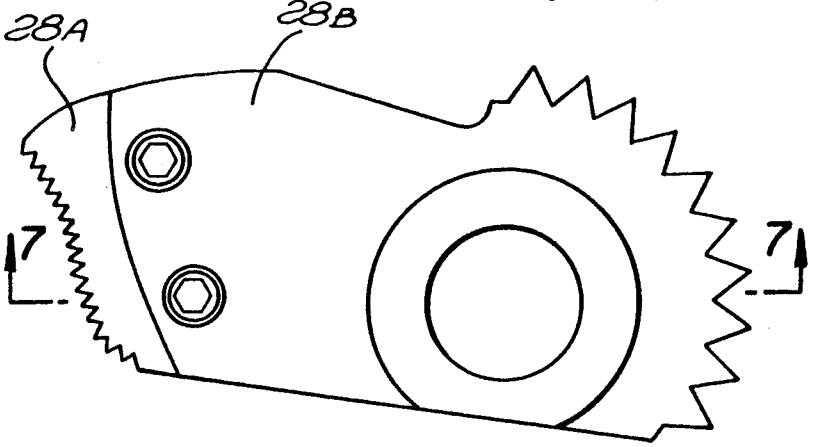
FIG. 6 is a plan view of a jaw and insert according to the present invention.

FIG. 6 shows that the increasing cam angle feature of the present invention can be manifested in the form of a replaceable insert 28A which can be mounted to a jaw 28B capable of accepting such an insert. An advantage using such inserts is the fact that a multiple increasing cam angle shapes and, accordingly, radial force limits, can be created with a single power tong.

Figure 3:
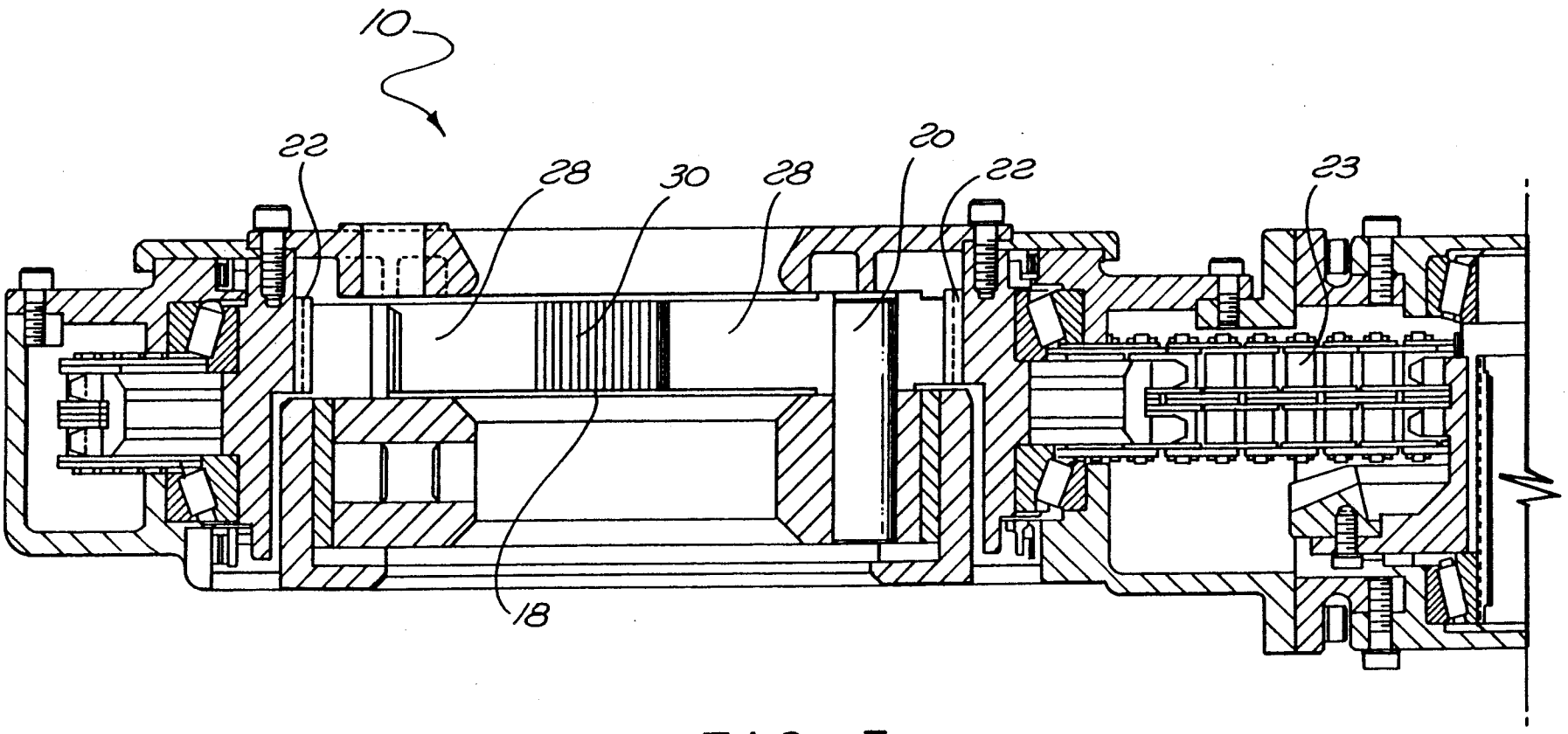
FIG. 3 is a cross sectional view taken along line 3—3 of FIG. 2.
Figure 7:
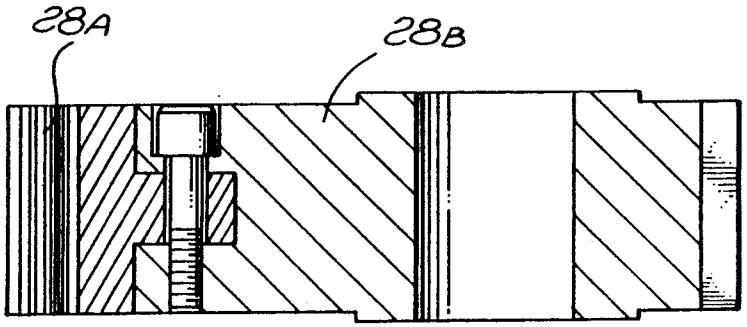
FIG. 7 is a view taken along line 7—7 of FIG. 6.
Figure 5:
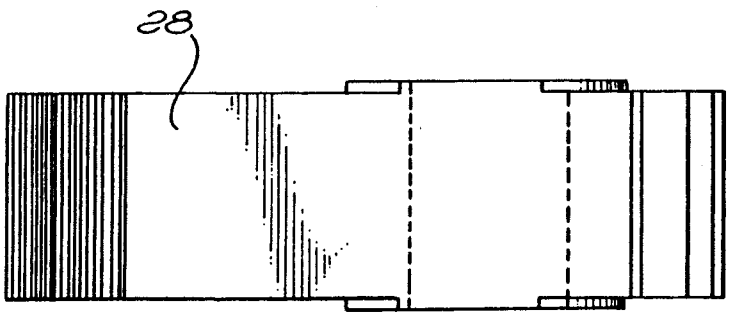
FIG. 5 is a view taken along line 5—5 in FIG. 4.

FIG. 3, 5 and 7 show cross sectional views of the certain configurations and elements discussed above, and are included to provide further details of construction for those skilled in the art. Of course, all elements constituting the present invention can be formed by conventional techniques known to those skilled in the art. Further, those skilled in the art will appreciate the various views shown above are not necessarily to scale, most variations therefrom being in the interest of clarity. Still further, those skilled in the art will recognize that specific configurations described herein may be modified without departing from the scope and spirit of the present invention recited in the appended claims.

I claim:

1. In a torqueable apparatus for gripping a tubular member having a central axis, a jaw assembly comprising:

at least one gripping member capable of pivoting on a pivot axis, said gripping member having a gripping surface portion in the shape of an ogee which contacts a gripped tubular member on a contact line, the contact line shiftable with respect to said surface portion from a line of initial contact on the convex part of the ogee to a line of final gripping on the concave part of ht ogee in response to torque applied to the assembly, said gripping member lying generally in a plane orthogonal to the central axis of the gripped tubular member, which plane intersects the central axis, pivot axis and contact line at a central point, pivot point and contact point respectively;

the line from the pivot point through the central point and the line from the pivot point through the contact point defining a cam angle, said gripping surface shaped so that the cam angle increases as the contact line shifts from the line of initial contact to the line of final gripping.

2. The jaw assembly of claim 1 wherein said gripping surface is an integral portion of said gripping member.

3. The jaw assembly of claim 1 wherein said gripping member comprises at least two separable elements, one of which is a removable insert element on which said gripping surface portion is formed.

4. An apparatus for gripping the outer surface of a structure having a center axis, which apparatus operates in a position generally orthogonal to the center axis of the structure, in which position a torque may be applied to said apparatus to rotate said structure, said apparatus including at least one jaw having an ogee shaped gripping surface with the convex portion of the gripping surface positioned for engaging said outer surface upon initial application of torque to said structure and the concave portion of the gripping surface positioned for engaging said outer surface upon additional application of torque to said structure.

5. In a power tong comprising a rotor carrying a plurality of pivotally mounted jaws having pipe gripping surfaces positioned to grippingly engage and apply tangential force to a pipe passing through the tong upon rotation of said rotor, the improvement in which the gripping surface is in the form of an ogee, having both a convex portion and a concave portion, such portions being oriented so that initial contact with the pipe is made by the convex portion of the gripping surface, and upon further application of tangential force the concave portion of the gripping surface engages the pipe.

* * * * *